US011603833B2

(12) United States Patent
Brown et al.

(10) Patent No.: US 11,603,833 B2
(45) Date of Patent: Mar. 14, 2023

(54) AIR COMPRESSORS FOR USE WITH A VEHICLE

(71) Applicant: ARB Corporation Limited, Kilsyth (AU)

(72) Inventors: Andrew Harry Brown, Kilsyth (AU); Daniel Jason Bongard, Kilsyth (AU); Samuel Benjamin Steward, Kilsyth (AU); Anthony Joseph Dervaric, Kilsyth (AU); John Desmond Clark, Kilsyth (AU)

(73) Assignee: ARB Corporation Limited, Kilsyth (AU)

( * ) Notice: Subject to any disclaimer, the term of this patent is extended or adjusted under 35 U.S.C. 154(b) by 0 days.

(21) Appl. No.: 17/126,597

(22) Filed: Dec. 18, 2020

(65) Prior Publication Data

US 2021/0190056 A1 Jun. 24, 2021

(30) Foreign Application Priority Data

Dec. 20, 2019 (AU) ..... 2019904856

(51) Int. Cl.

| | |
|---|---|
| ***F04B 35/04*** | (2006.01) |
| ***F04B 49/20*** | (2006.01) |
| ***F04B 39/06*** | (2006.01) |
| ***F04B 39/12*** | (2006.01) |
| ***F04B 53/08*** | (2006.01) |

(Continued)

(52) U.S. Cl.

CPC ..... *F04B 35/04* (2013.01); *F04B 39/06* (2013.01); *F04B 39/064* (2013.01); *F04B 39/066* (2013.01); *F04B 39/12* (2013.01); *F04B 39/121* (2013.01); *F04B 49/20* (2013.01); *F04B 53/007* (2013.01); *F04B 53/08* (2013.01); *F04B 53/16* (2013.01); *F04B 2201/0801* (2013.01); *F04B 2203/0201* (2013.01)

(58) Field of Classification Search

CPC ..... F04B 35/04; F04B 39/06; F04B 39/066; F04B 39/064; F04B 39/121; F04B 53/08; F04B 53/16; F04B 53/007; F04B 49/20; F04B 2201/0801; F04B 2203/0201

See application file for complete search history.

(56) References Cited

U.S. PATENT DOCUMENTS 2,106,488 A * 1/1938 McCune ..... F04B 53/122 417/203

5,126,642 A * 6/1992 Shahrodi ..... H02P 27/08 318/433

(Continued)

*Primary Examiner* — Christopher S Bobish

(74) *Attorney, Agent, or Firm* — Bookoff McAndrews, PLLC

(57) ABSTRACT

Air compressor 10 for a vehicle, including at least one cooling duct 30 arranged to convey air from outside of the compressor 10, alongside a sealable chamber 28 containing a motor 22, alongside a cylinder 12, and through a cylinder head 18 to emit from at least one exhaust 32 spaced from an air inlet 20, and a fan 34 operable to impel air through the, or each, cooling duct 30. Alternatively or additionally, the compressor 10 includes a sensor 56 arranged to sense a critical parameter of the compressor 10, and a controller in communication with the motor 22 and the sensor 56, the controller configured to control operation of the motor 22 to adjust a rotational speed of a shaft 24 responsive to receiving a sensed value from the sensor 56.

21 Claims, 9 Drawing Sheets

(51) Int. Cl.
*F04B 53/16* (2006.01)
*F04B 53/00* (2006.01)

(56) References Cited

U.S. PATENT DOCUMENTS

| | | | | | |
|---|---|---|---|---|---|
| 5,584,675 | A * | 12/1996 | Steurer | F04B 39/066 | 417/372 |
| 6,227,821 | B1 * | 5/2001 | Leu | F04B 35/04 | 417/415 |
| 6,331,101 | B2 * | 12/2001 | Leu | F04B 35/04 | 417/415 |
| 8,328,524 | B2 * | 12/2012 | Iimura | F04B 49/065 | 417/18 |
| 8,403,648 | B2 * | 3/2013 | Boscarato | F04B 49/10 | 417/32 |
| 11,187,218 | B2 * | 11/2021 | Vieira | F04B 25/005 | |
| 2008/0131289 | A1 * | 6/2008 | Koehl | F04B 49/065 | 417/32 |
| 2015/0152860 | A1 * | 6/2015 | Darak | F04D 27/004 | 417/12 |
| 2018/0306179 | A1 * | 10/2018 | Hembree | F04B 53/14 | |
| 2020/0362867 | A1 * | 11/2020 | Fox | F04D 15/0088 | |
| 2021/0017974 | A1 * | 1/2021 | Lin | F04B 27/005 | |
| 2021/0246892 | A1 * | 8/2021 | Mitchell | F04B 53/08 | |

* cited by examiner

AIR COMPRESSORS FOR USE WITH A VEHICLE

TECHNICAL FIELD

The present disclosure relates, generally, to air compressors for use with a vehicle, and, more particularly, to such air compressors which are sealed to prevent moisture and dust ingress.

BACKGROUND

Air compressors are used to pressurize air for a range of applications, such as operating pneumatic tools.

Some air compressors are intended for use with vehicles, including manually portable compressors and vehicle-mounted compressors. Such compressors are configured to be powered by the vehicle's battery. The pressurised air is commonly used to inflate tyres, power pneumatic locking differentials, and/or power pneumatic tools. Such compressors are typically used in relation to off-road (commonly referred to as "4×4" or "4WD") vehicles.

Some vehicle air compressors are sealed to prevent moisture and dust ingress to enhance reliability in adverse environmental conditions. Such compressors house an electric motor in a sealed chamber to prevent moisture and dust ingress to the motor. However operating motors housed in a sealed chamber generates heat which can damage the motor. This issue is typically managed by limiting duration of operation of the motor to manage motor temperature. For example, this often involves utilising a thermal cut-out switch which prevents power being supplied to the motor when the temperature of the motor exceeds a defined critical threshold. When the motor temperature falls significantly below the threshold, the switch restores power being supplied to the motor.

Restricting operation of motors in this way means that such air compressors are specified to have a repeatable "duty cycle", being a cycle of operation which is repeatable without generating damaging residual heat. The duty cycle is typically expressed as a percentage of an hour period which the compressor, operated in a specific ambient temperature, can operate throughout without the compressor reaching a critical temperature threshold (referred to as "run time"). For example, where a compressor repeatedly runs for 30 minutes before being inoperable for 30 minutes (to allow sufficient cooling to prevent damage due to heat—referred to as "off time") this defines a duty cycle of 50%.

A compressor having a duty cycle of less than 100% will mean that, during use, the compressor will be periodically inactive. This can be inconvenient for users, for example, if only three of four tyres are inflated with air pressurised by the compressor before the compressor must be inactive, as the user must then wait through the off time period until the compressor is operable again to complete the task. This issue is exacerbated in extremely hot conditions, such as in deserts, where high ambient temperatures reduce air density, increase the compressor's temperature and reduce cooling efficiency, consequentially affecting the duty cycle by reducing the run time period and increasing the off time period. This often substantially lengthens the duration of a task, such as filling tyres with air, which can dangerously increase a user's exposure to extreme environmental conditions.

Any discussion of documents, acts, materials, devices, articles or the like which has been included in the present specification is not to be taken as an admission that any or all of these matters were common general knowledge in the field relevant to the present disclosure as it existed before the priority date of each of the appended claims.

SUMMARY

According to some disclosed embodiments, there is provided an air compressor for use with a vehicle, the air compressor including: a cylinder defining a bore; a piston slidably arranged within the bore; a cylinder head arranged across an end of the cylinder; an air inlet arranged to convey air from outside of the air compressor into the cylinder; an electric motor having a motor shaft operatively connected to the piston such that rotating the motor shaft causes the piston to reciprocate to compress air in the cylinder; a housing defining a sealable chamber, wherein the motor is sealably contained within the chamber; a first sensor arranged to sense a critical parameter of the air compressor; and a controller in communication with the motor, the first sensor and a memory configured to store critical parameter threshold values, the controller configured to control operation of the motor to adjust a rotational speed of the motor shaft. Responsive to the controller receiving a sensed value from the first sensor, the controller is configured to communicate with the memory to determine a difference between the sensed critical parameter and a relevant critical parameter threshold. Responsive to the controller determining the difference, the controller is configured to determine an adjustment factor and cause the motor to adjust the rotational speed of the motor shaft by the adjustment factor.

The controller may be configured so that responsive to the controller determining the sensed critical parameter is greater than the relevant critical parameter threshold, the controller determines a negative adjustment factor and causes the motor to reduce the rotation speed of the motor shaft by the adjustment factor.

The controller may be configured so that responsive to the controller receiving the sensed value from the first sensor, the controller compares the sensed value to historical sensed values stored in the memory to determine a rate of change, and be further configured so that determining the adjustment factor includes assessing the rate of change.

The first sensor may be arranged to sense current drawn by the motor, and the air compressor may also include a second sensor arranged to sense a temperature of the air compressor, and wherein the controller is in communication with the second sensor to receive a sensed temperature.

The second sensor may be arranged to sense a temperature of the cylinder head, and at least one of the memory and the controller be arranged on a PCB, and the air compressor may also include a third sensor arranged to sense a temperature of the PCB, and wherein the controller is in communication with the third sensor to receive a sensed temperature value. In such embodiments, the PCB may be sealably contained within the sealable chamber of the housing.

The controller may be configured to communicate with each of the sensors to assess sensed values and determine a plurality of adjustment factors, each adjustment factor relating to one of the sensed critical parameters.

The controller may be configured so that responsive to the controller determining the plurality of adjustment factors, the controller causes the motor to adjust the rotational speed of the motor shaft by the greatest reduction factor.

The controller may be configured so that responsive to causing the rotational speed of the motor shaft to be adjusted, the controller repeats communicating with each of the sensors to effect operating in a cyclical routine.

The air compressor may also include at least one cooling duct arranged to convey air from outside of the air compressor, alongside the motor and cylinder, and through the cylinder head to emit from at least one exhaust spaced from the air inlet.

According to other disclosed embodiments, there is provided an air compressor including: a cylinder defining a bore; a piston slidably arranged within the bore; an air inlet arranged to convey air from outside of the air compressor into the cylinder; an electric motor having a motor shaft operatively connected to the piston such that rotating the motor shaft causes the piston to reciprocate to compress air in the cylinder; a housing defining a sealable chamber, wherein the motor is sealably contained within the chamber; at least one cooling duct arranged to convey air from outside of the air compressor, alongside the sealable chamber, and alongside the cylinder to emit from at least one exhaust spaced from the air inlet; and a fan operable to impel air through the, or each, cooling duct.

The air inlet may be arranged to receive air in a first direction and the, or each, exhaust be arranged to emit air in a second direction perpendicular to the first direction.

The, or each, exhaust may be arranged operatively above the air inlet.

The, or each, exhaust may be arranged operatively above the cylinder.

The housing may define at least one passage extending parallel and separate to the chamber to convey air alongside the chamber and through the housing.

The housing may define at least one conduit arranged to convey air from the at least one passage through a right angle to the cylinder head.

The housing may include a plurality of bodies, wherein a first body defines the sealable chamber and the at least one passage, and a second body defines the at least one conduit.

The air compressor may also include cylinder head configured to receive and surround the cylinder to define at least one cooling chamber extending parallel to the cylinder to convey air alongside the cylinder, wherein the at least one cooling chamber is arranged to convey air from the at least one conduit and through the cylinder head to the at least one exhaust.

The air compressor may also include: a sensor arranged to sense a critical parameter of the air compressor; a controller in communication with the motor, the first sensor and a memory configured to store critical parameter threshold values, and configured to control operation of the motor to adjust a rotational speed of the motor shaft; and wherein, responsive to the controller receiving a sensed value from the first sensor, the controller is configured to communicate with the memory to determine a difference between the sensed critical parameter and a relevant critical parameter threshold, and responsive to the controller determining the difference, the controller determines an adjustment factor and causes the motor to adjust the rotational speed of the motor shaft by the adjustment factor.

According to further disclosed embodiments, there is provided an air compressor assembly including a pair of the air compressors as described above and a cylinder head housing shaped to receive the cylinder of each of the compressors to join the air compressors together. In such embodiments, the cylinder head housing may define each exhaust.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

It will be appreciated embodiments may comprise steps, features and/or integers disclosed herein or indicated in the specification of this application individually or collectively, and any and all combinations of two or more of said steps or features.

BRIEF DESCRIPTION OF DRAWINGS

Embodiments will now be described by way of example only with reference to the accompany drawings in which.

DESCRIPTION OF EMBODIMENTS

Figure 1:
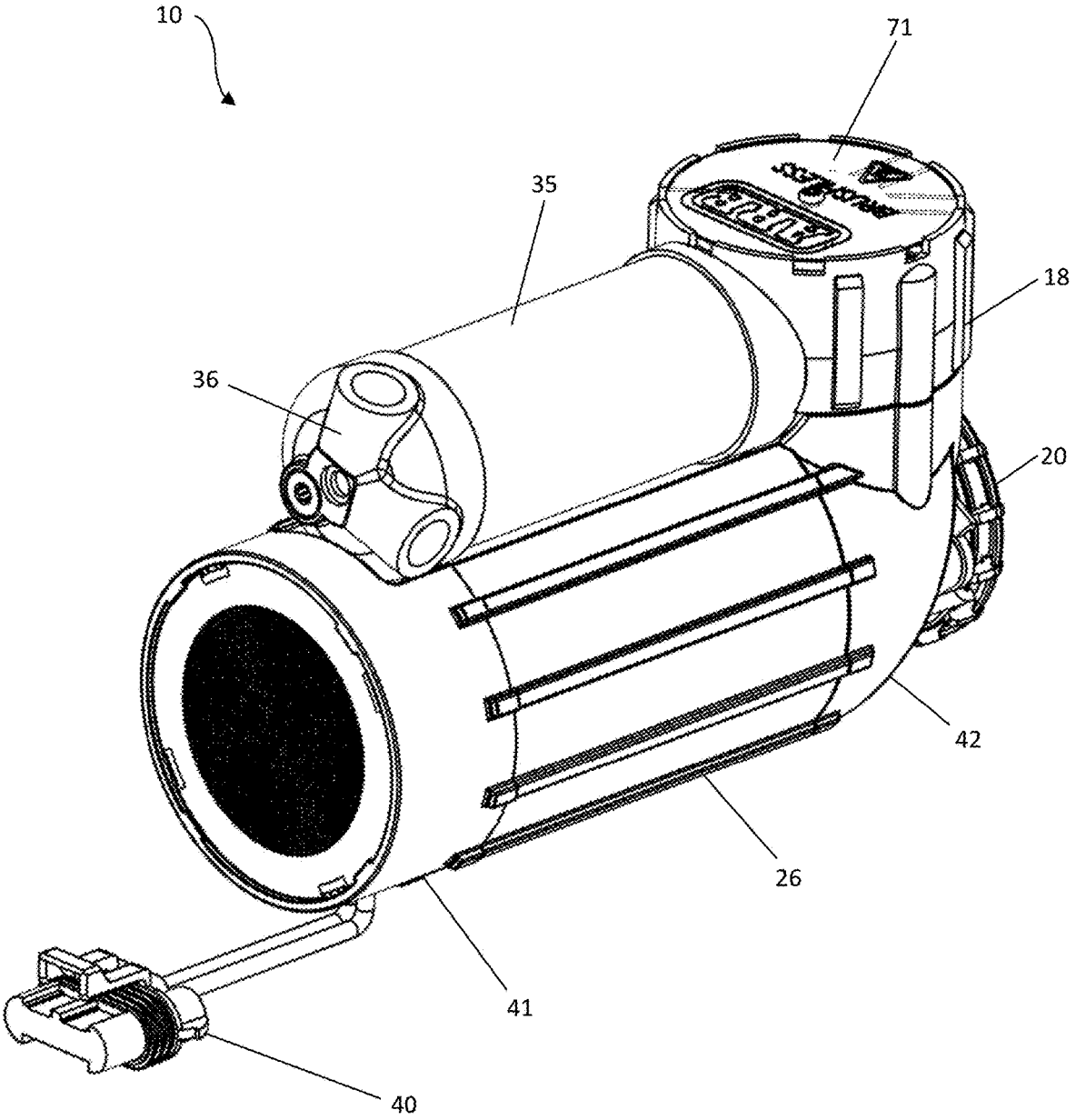
FIG. 1 is a top perspective view of an air compressor.

In the drawings, reference numeral 10 generally designates an air compressor 10 for a vehicle (not illustrated). The air compressor 10 is configured to be a portable compressor or a vehicle-mounted compressor. It will be appreciated that the air compressor 10 is not limited for use with vehicles and may be used for other applications, such as to drive pneumatic power tools in construction or maintenance situations.

The air compressor 10 includes a cylinder 12 defining a bore 14, a piston 16 slidably arranged within the bore 14, a cylinder head 18 arranged across an end of the cylinder 12, an air inlet 20 arranged to convey air from outside of the air compressor into the cylinder 12, an electric motor 22 having a motor shaft 24 operatively connected to the piston 16 such that rotating the motor shaft 24 causes the piston 16 to reciprocate to compress air in the cylinder 12, a housing 26 defining a sealable chamber 28, wherein the motor 22 is sealably contained within the chamber 28, at least one cooling duct 30 arranged to convey air from outside of the air compressor 10, alongside the sealable chamber 28, alongside the cylinder 12, and through the cylinder head 18, to emit from at least one exhaust 32 spaced from the air inlet 20, and a fan 34 operable to impel air through the, or each, cooling duct 30.

Figure 2:
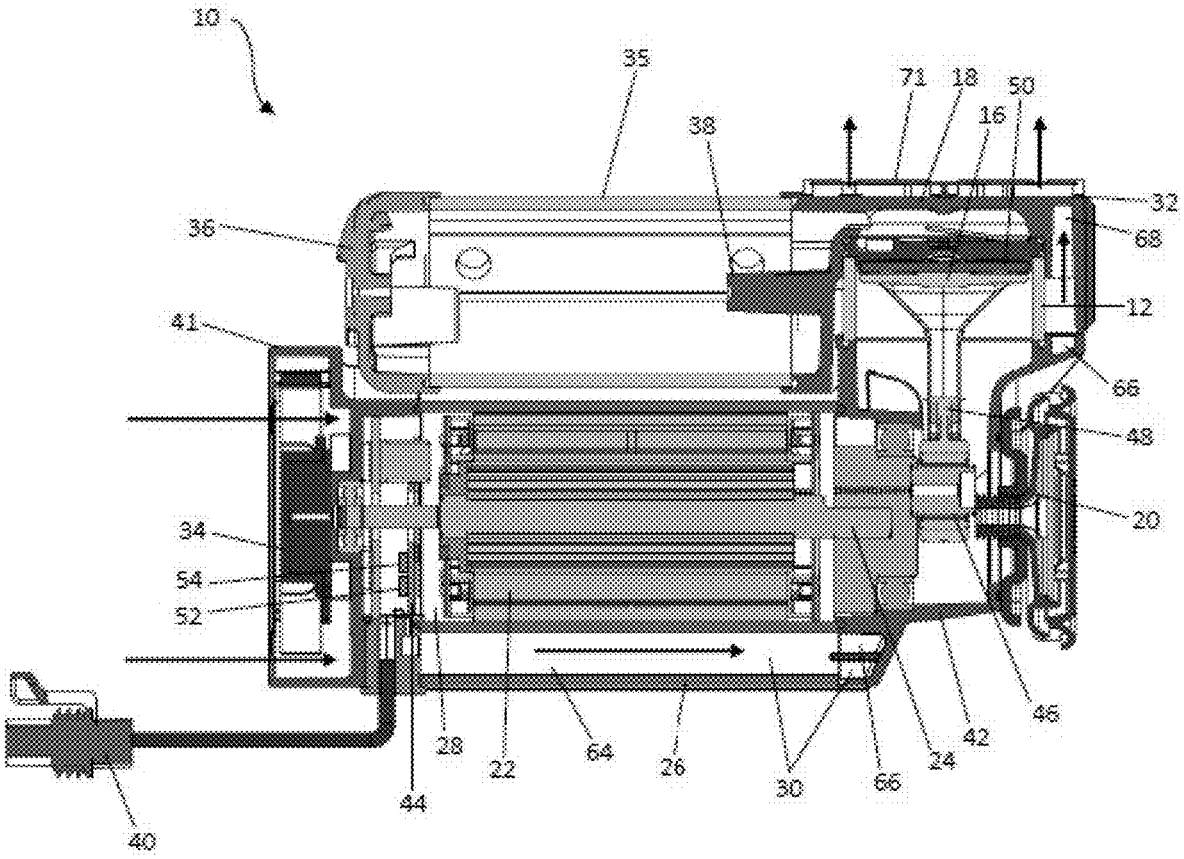
FIG. 2 is a cross-section side view of the compressor shown in FIG. 1.
Figure 3:
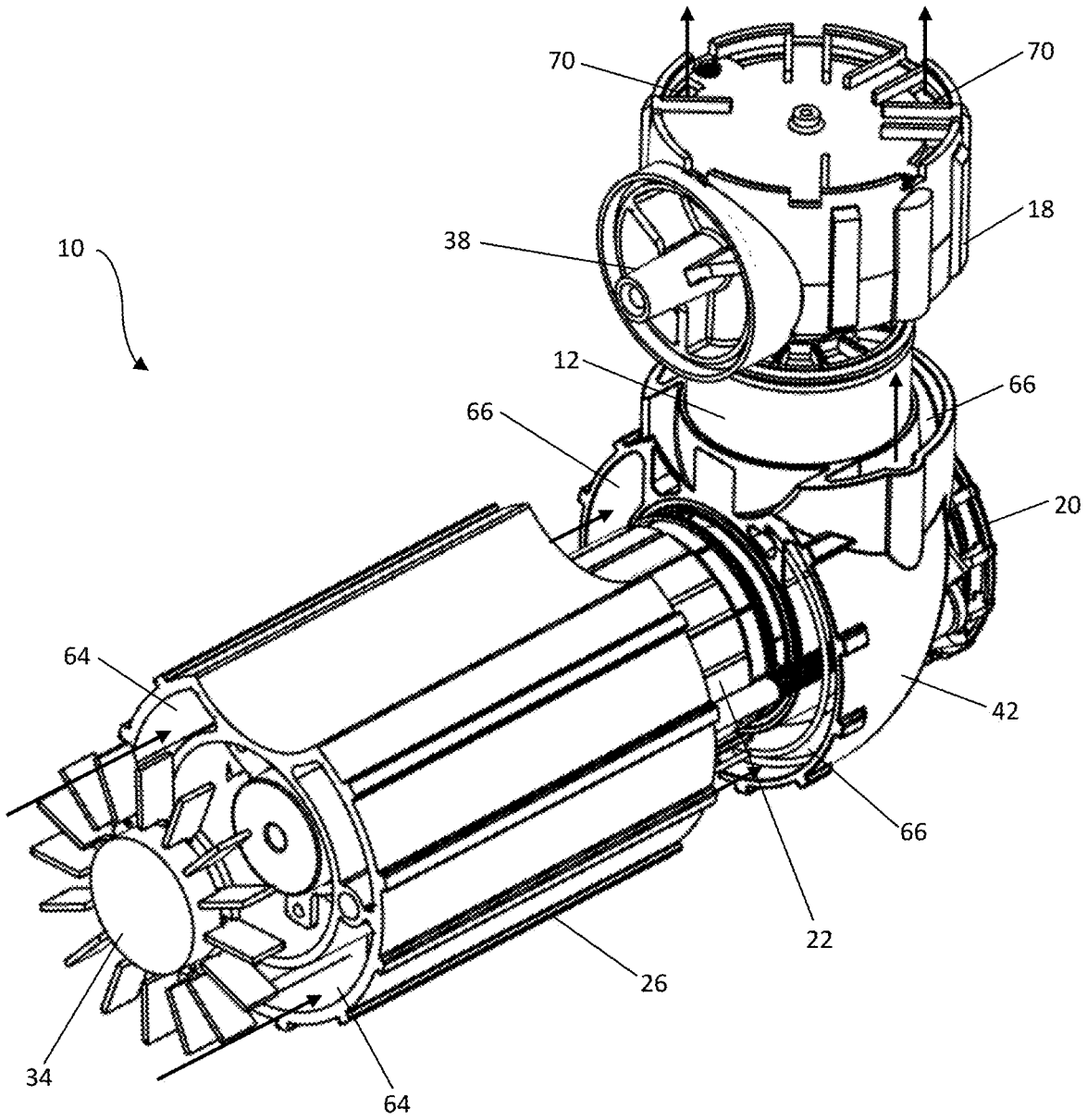
FIG. 3 is an exploded top perspective view of the compressor shown in the previous figures with some of the components of the compressor hidden.

FIGS. 1 to 3 illustrate an embodiment of the air compressor 10. The compressor 10 is configured to be powered by a DC power source, typically being a battery of greater than 40 A, such as is commonly on-board a vehicle. The compressor 10 includes an electrical connector 40 for connecting to a wiring loom (not shown) which is connected to the battery.

The compressor 10 is specified to be sufficiently small and lightweight to be manually portable by a user, such as being carried in a case, or is mountable to the vehicle, such as in the engine bay or in a tub of a utility vehicle. The compressor 10 is mountable via a mounting bracket (not shown) in a vertical orientation (as shown in FIG. 1) or in a horizontal orientation, where the cylinder head 18 is rotated through 90 degrees to be adjacent the mounting bracket and/or mounting surface. In some embodiments, the compressor 10 is mounted horizontally next to another, identical compressor and operated in tandem to provide additional output.

The cylinder head 18 is connected to a manifold tube 35 which, in turn, is connected to a manifold cap 36. The cylinder head 18 includes an air outlet 38 arranged to convey compressed air from the cylinder 12 to the tube 35 and cap 36. The cap 36 is configured to connect to a hose (not shown). The hose is connectable directly to an application to convey air to the application, such as a tyre, or may be connected to a storage tank (not shown) to convey air into the tank which is subsequently supplied to an application.

Best shown in FIG. 2, the motor 22 is arranged in the sealable chamber 28 defined by the housing 26. The chamber 28 is sealed at one end by a fan housing 41 and at the other end by a crankcase 42. A printed circuit board (PCB) 44 is arranged within the chamber 28 at one end of the motor 22. The motor shaft 24 extends from the other end of the motor 22 to engage a crankshaft 46. The piston 16 is connected to the crankshaft 46 by a piston rod 48. The piston 16 is sealed against the bore 14 by a peripheral seal 50. Rotation of the crankshaft 46, by the motor 22 rotating the motor shaft 24, causes the piston 16 to reciprocate through the bore 14. The motor 22 is typically configured as a brushless motor to enhance control of rotational speed of the shaft 24.

The PCB 44 includes a microprocessor 52 having a memory 54. The microprocessor 52 is configured to operate as a controller to control operation of the motor 22, including adjusting rotational speed of the motor shaft 24. The memory 54 is configured to store a range of threshold values relating to critical parameters of the air compressor 10, as discussed in greater detail below. In the illustrated embodiment, the microprocessor 52, having controller functionality, and memory 54 are integrated. In other embodiments (not illustrated), the microprocessor 52 may be separate from and communicatively connected to a controller module and a memory store. For example, the memory store may be remotely hosted and accessed via a wireless connection, or via the Internet.

In the illustrated embodiment, the PCB 44, carrying the microprocessor 52, is mounted within the sealable chamber 28 to be internally housed within the housing 26. In some embodiments (not illustrated), the PCB 44 is mounted externally to the housing 26, such as being secured adjacent the manifold tube 35. In other embodiments (not illustrated), the PCB 44 is mounted remotely from the compressor 10, such as within the vehicle. In yet other embodiments (not illustrated), the controller is configured as an application executable by a computing device, such as a smartphone, and the PCB 44 is substituted with a communications module configured to communicate with the computing device to allow remote hosting of the controller functionality.

The thresholds are defined according to measurable parameters relating to use of the compressor 10 which could cause damage to the compressor 10 or associated components. For example, in embodiments configured to be powered by a 12V battery, the memory 54 stores a maximum current threshold corresponding with the 12V battery to limit current able to be drawn by the motor 22 to avoid damaging the motor 22. Similarly, the memory 54 stores a maximum motor 22 temperature threshold defined to be the maximum temperature which the motor 22 can operate at without damaging the motor 22.

The compressor 10 includes at least one sensor configured and arranged to sense at least one critical parameter of the compressor 10. In the embodiment illustrated in FIGS. 1 to 3, the compressor 10 includes three sensors 56, 58, 60. A first sensor 56 is arranged on the PCB 44 to sense current drawn by the motor 22, a second sensor 58 is arranged in the crank case 42 to sense a temperature of the cylinder head 18, and a third sensor 60 is arranged on the PCB 44 to sense a temperature of the PCB 44.

The sensors 56, 58, 60 allow monitoring power consumption to optimise operation of the PCB 44, and monitoring two critical temperatures which, if exceeded, would cause damage to components of the compressor 10, such as the piston seal 50 or valves (not illustrated) associated with the exhaust 32. It will be appreciated that in other embodiments the compressor 10 may include other sensors to sense other critical parameters, such as any of a torque sensor (not shown) to sense torque exerted by the motor shaft 24, further temperature sensors (not shown), such as to sense a temperature of other parts of the cylinder head 18 and/or housing 26, and/or a tachometer (not shown) to sense revolutions-per-minute of the crankshaft 46.

The microprocessor 52 is configured to communicate with each of the sensors 56, 58, 60 to receive sensed values, and communicate with the memory 54 to access the threshold values. The microprocessor 52 is operable to control operation of the motor 22 to adjust a rotational speed of the motor shaft 24. The microprocessor 52 and sensors 56, 58, 60 operate together to define a closed-loop control system to regulate operation of the compressor 10. This is discussed in greater detail below.

In the illustrated embodiment the motor 22 is a brush-less motor 22. The microprocessor 52 causes the speed of the motor shaft 24 to be adjusted by applying power to the motor 22 in variable pulses, according to a pulse width modulation (PWM) waveform.

FIGS. 2 to 4, 6 and 9 illustrate a fluid flow path defined by the cooling duct 30. This extends through the housing 26, crankcase 42 and cylinder head 18 to emit from a plurality of the exhausts 32. The air, indicated by arrows, is impelled by the fan 34 into a passage 64, defined by the housing 26, extending parallel and alongside the sealable chamber 28, through a conduit 66, defined by the crankcase 42, to pass around an internal chamber housing the crankshaft 46 and motor shaft 24, and then through a cooling chamber 68, defined between the cylinder 12 and the cylinder head 18, to exit through the exhausts 32, in the embodiment shown, defined as apertures 70 in a top surface of the cylinder head 18. The air then flows around a periphery of an exhaust plate 71 (FIG. 1) to exit from the compressor 10.

The exhausts 32 are arranged to emit air from the cooling duct 30 in a perpendicular direction to the air travelling into the air inlet 20. This is useful as this directs hot air exiting the cooling duct 32 away from the air inlet 20. This is enhanced by the housing 26 being configured so that the compressor 10 is mountable or otherwise positionable on a surface to be orientated in the vertical orientation, as shown in FIGS. 1 to 3. This advantageously arranges the exhausts 32 operatively above the air inlet 20 to further enhance directing the hot air away from the air inlet 20. This enhances efficiency of the compressor 10 as this avoids or reduces emitted heated air, which has a reduced density, entering the cylinder 12 and being compressed, which would decrease load on the motor 22 consequently reducing output. Similarly, the exhausts 32 are arranged operatively above the cylinder 12 to optimise cooling of the cylinder 12 by air passing along its length through the duct 30.

In the illustrated embodiment, the cooling duct 30 is defined by the housings 26, 42, 18 of the compressor 10 to provide an internally ducted system. This is useful as this arrangement enhances cooling of the housings 26, 42, 18 and contained components by communicating the air through the housings 26, 42, 18. It will be appreciated that in other embodiments (not shown), one or more external cooling ducts, such as defined by externally mounted hoses, may be secured to the housings 26, 42, 18 to cool the compressor 10.

Figure 4:
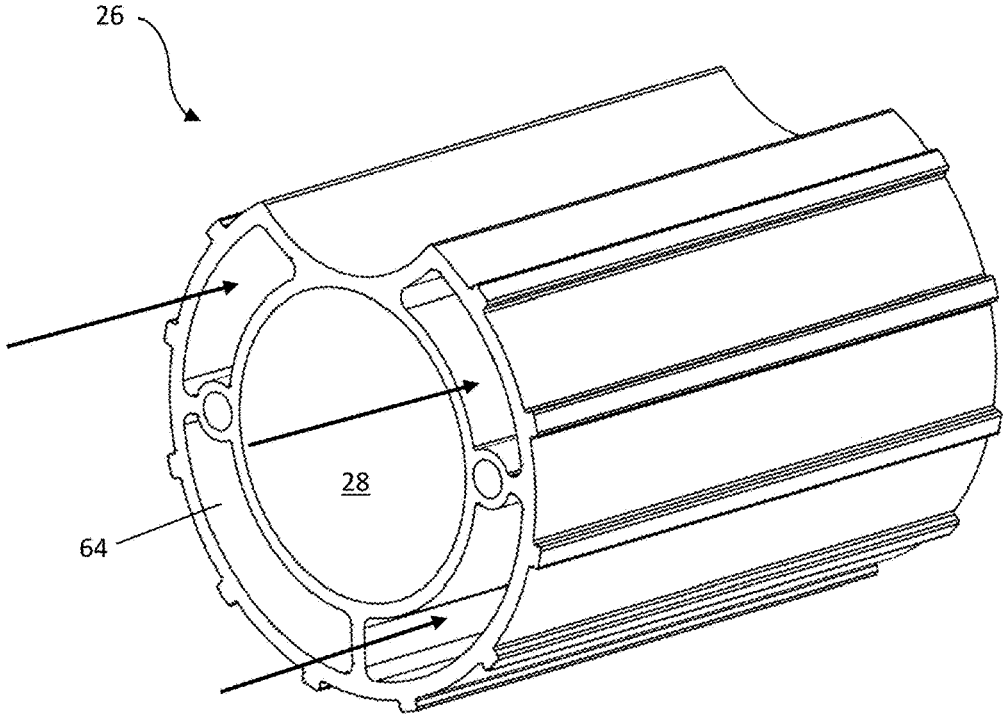
FIGS. 4 and 5 are top perspective and end views, respectively, of a housing which forms part of the compressor shown in FIGS. 1 to 3.
Figure 5:
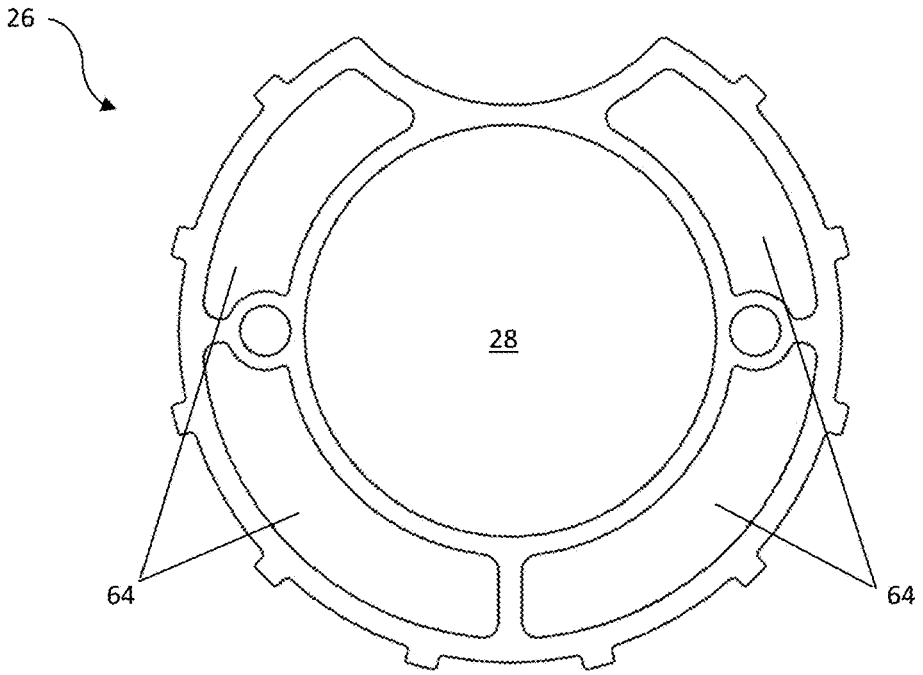

Best shown in FIGS. 4 and 5, the housing 26 defines four passages 64 arranged about the sealable chamber 28 to extend through the housing 26. It will be appreciated that the number of passages 64 is merely illustrative and that, in other embodiments, the housing 26 may define more or less passages 64.

Figure 6:
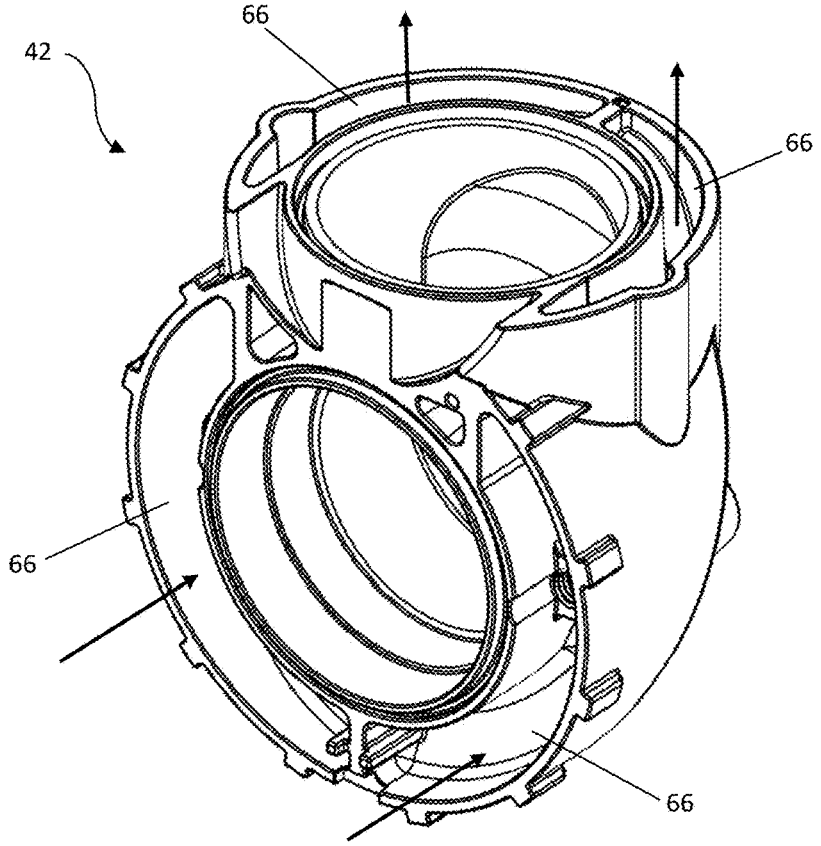
FIGS. 6 to 8 are top perspective, side and top views, respectively, of another housing which forms part of the compressor shown in FIGS. 1 to 3.
Figure 7:
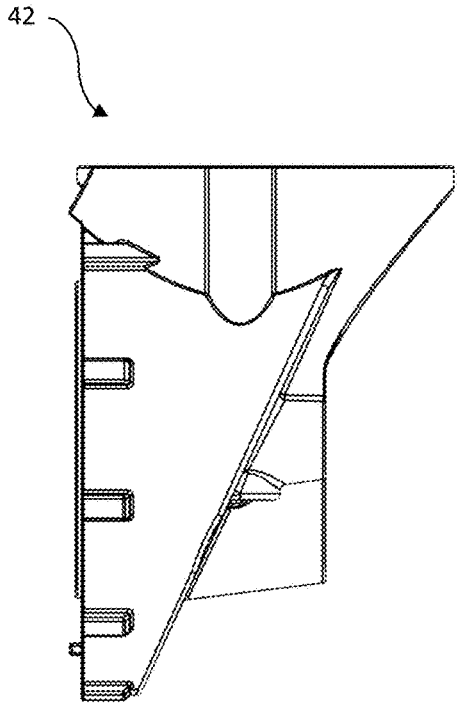
Figure 8:
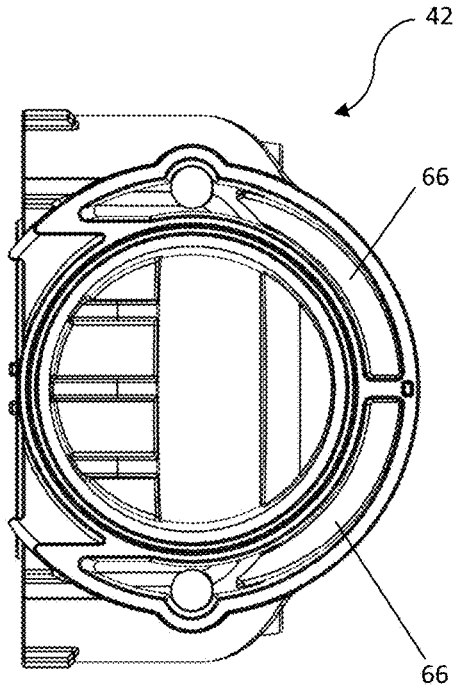

FIGS. 6 to 8 show the crankcase 42 defines two conduits 66 each arranged to receive air from two of the passages 64 and convey the air through a right angle to the cylinder head 18. Again, it will be appreciated that the number of conduits 66 is merely illustrative and that, in other embodiments, the crankcase 42 may define more or less conduits 66.

In other embodiments (not shown), the housing 26 and crankcase 42 may be integrally formed in a single body. It will be appreciated that in other embodiments, the housing 26 and crankcase 42 may be configured as alternative bodies, such as a mirrored pair of bodies.

Figure 9:
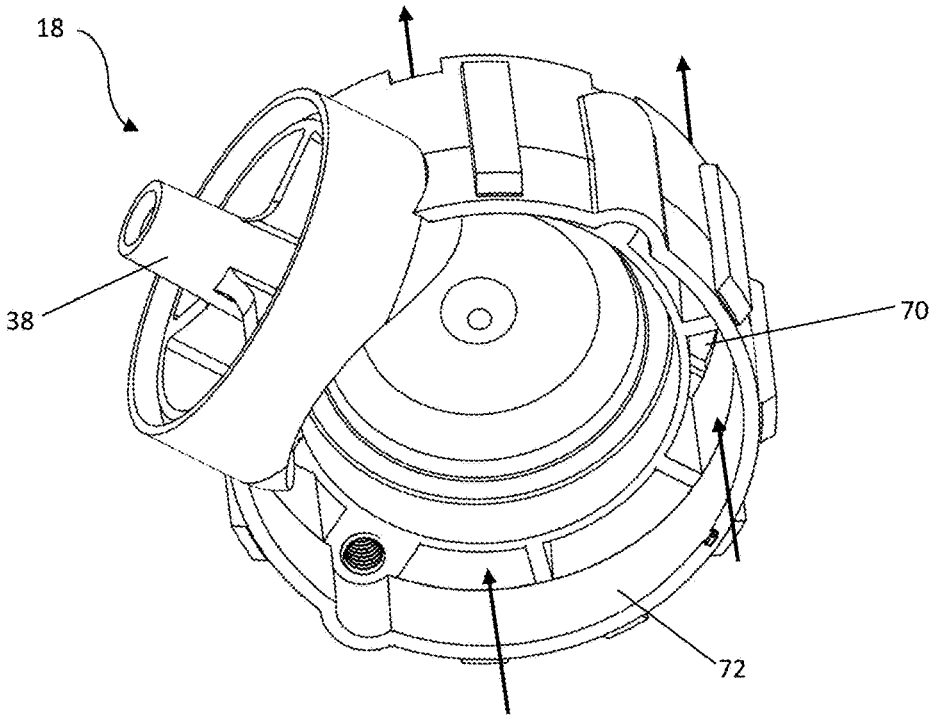
FIGS. 9 and 10 are underside perspective and underside views, respectively, of a cylinder head which forms part of the compressor shown in FIGS. 1 to 3.
Figure 10:
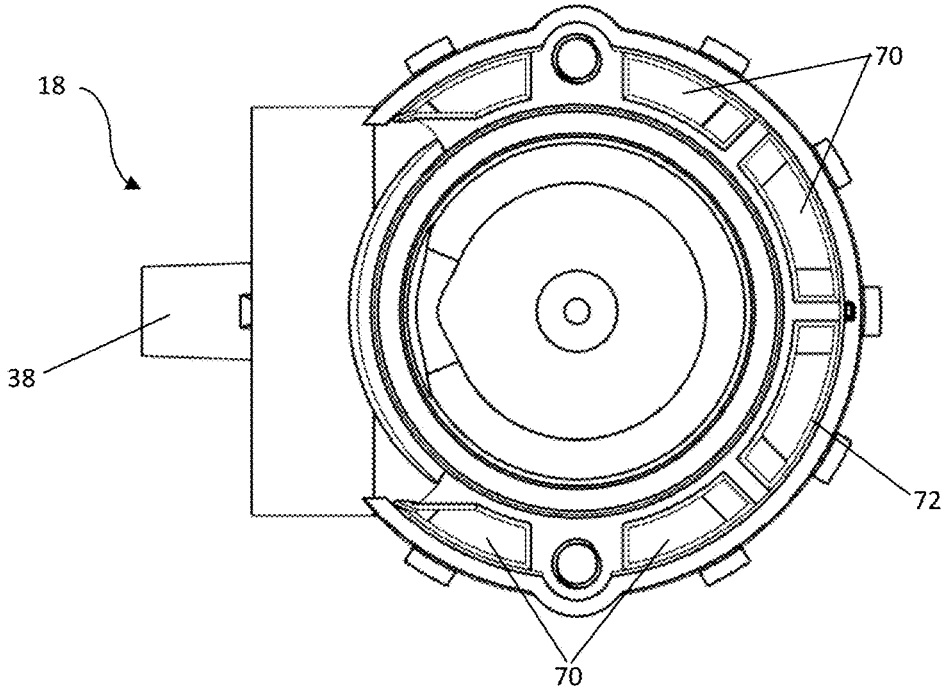

FIGS. 9 and 10 show an underside of the cylinder head 18 illustrating an internal wall 72 arranged to partially surround the cylinder 12 to define the cooling chamber 68 between an outside of the cylinder 12 and the wall 72. Best shown in FIG. 10, a radial array of the apertures 70 extends through the top surface of the cylinder head 18 to emit air from the cooling chamber 68. In some embodiments, each aperture 70 is associated with a one-way valve to allow air to emit from the exhaust and prevent fluid or dust entering the aperture 70.

It will be appreciated that in some embodiments, the compressor 10 does not include any cooling duct 30. In such embodiments, the compressor 10 includes the microprocessor 52 and at least one sensor, as described above, and is operable to adjust rotational speed of the motor shaft 24 to regulate operation of the compressor 10, as described in greater detail below.

It will also be appreciated that in some embodiments, the compressor 10 does not include any sensors 56, 58, 60 or the PCB 44. In such embodiments, the compressor 10 only operates the fan 34 to drive air through the at least one cooling duct 30, as described above, to regulate the temperature and operation of the compressor 10.

Figure 11:
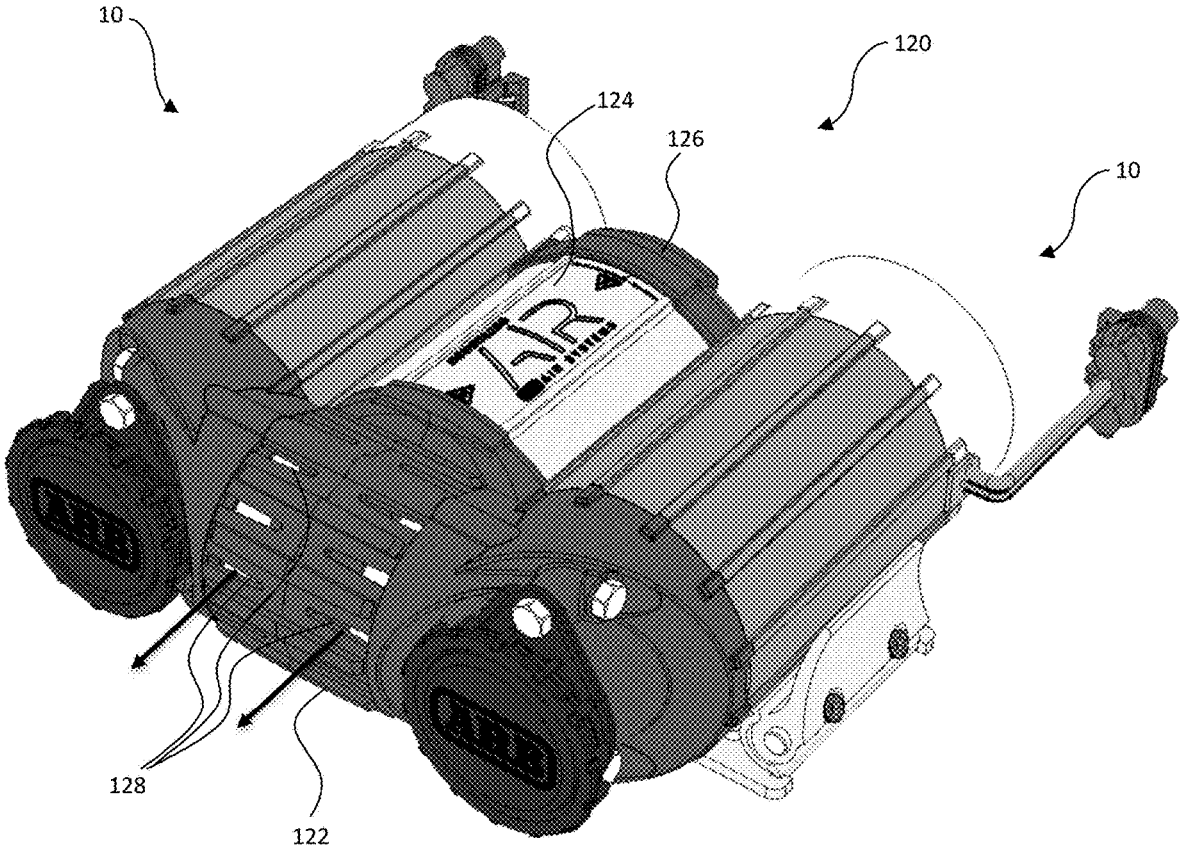
FIG. 11 is a perspective view of an alternative air compressor.

FIG. 11 shows an alternative air compressor 120 embodiment being an assembly including a pair of the compressors 10 (as described above and shown in FIGS. 1-3) arranged in a mirrored orientation relative to each other and joined by a common cylinder head housing 122. The cylinder head housing 122 replaces the cylinder head 18 of each compressor 10. The housing 122 is configured to receive the cylinder 12, and mate with the crankcase, of each of the compressors 10. The compressor 120 also includes a common, large capacity manifold tube 124 and manifold cap 126 which replace the manifold tube 35 and manifold cap 36 of each of the compressors 10. The cylinder head housing 122 is shaped internally to convey air compressed by each of the compressors 10 to the manifold tube 104 which, in turn, conveys the compressed air to the manifold cap 128. The manifold cap 126 includes an air outlet (not visible) configured to be connected to a hose (not shown) to allow the compressed air to be used.

The cylinder head housing 122 defines a plurality of exhaust slots 128 and is shaped internally to direct air received from the conduits 66 extending through each of the crankcases 42 to be emitted from at least some of the slots 128 and away from the compressor 120. In the illustrated embodiment, the cylinder head housing 122 is configured to exhaust the air through the two slots 128 arranged closest to an intake end of the compressor 120, as indicated by the arrows shown in FIG. 11. It will be appreciated that in other embodiments, the housing 122 may be configured to exhaust the air from alternative slots 128, or all of the slots 128.

Figure 12:
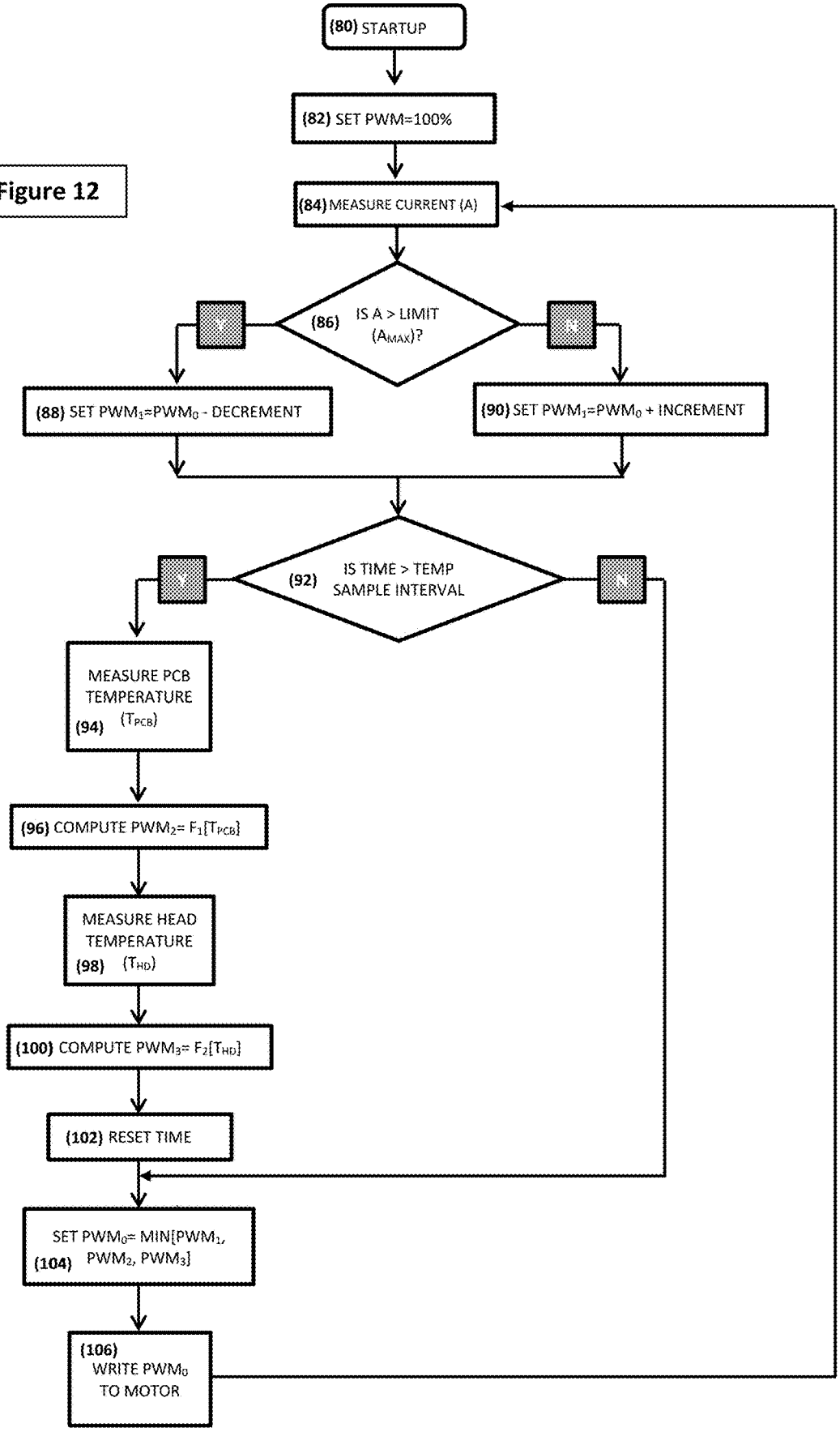
FIG. 12 is a flow chart illustrating stages of operation of the disclosed compressors.

FIG. 12 illustrates stages of operating the compressor 10 according to the closed loop control system defined by the microprocessor 52 (including the memory 54) and sensors 56, 58, 60.

Use involves initially activating the compressor 10 ("start-up"), at 80, by supplying power from a DC power source, such as a vehicle's battery, typically by the user operating a dash-mounted switch or other user interface, such as a touch screen of a control system. This causes the microprocessor 52, at 82, to set pulse width modulation (PWM) for the motor 22 to an initial value of 100%, causing the motor 22 to rotate the motor shaft 24 at a maximum rotational speed.

The microprocessor 52 communicates with the first sensor 56, at 84, to measure current (A) drawn by the motor 22, and, at 86, communicates with the memory 54 to identify the relevant threshold value ($A_{MAX}$) and determine a difference between A and $A_{MAX}$.

If A is greater than $A_{MAX}$, at 88, the microprocessor 52 calculates a negative adjustment factor, being a variable factor based on the difference between A and $A_{MAX}$, and determines a reduced PWM value ($PWM_1$) based on the calculated adjustment factor. This involves reducing $PWM_0$ by a decrement defined by the adjustment factor. When the compressor is initially operated $PWM_0$=100%, and $PWM_1$ is equal to 100% minus the decrement. Each cycle of operation thereafter $PWM_1$ is equal to $PWM_0$ as previously calculated by microprocessor 52 (discussed further below), minus the decrement.

Where A is less than $A_{MAX}$, at 90, the microprocessor 52 calculates a positive adjustment factor and determines an increased PWM value ($PWM_1$) based on the calculated adjustment factor. This involves increasing $PWM_0$ by an increment defined by the adjustment factor. When the compressor is initially operated so that $PWM_0$=100%, $PWM_1$ maintains the 100% value. Each cycle of operation thereafter $PWM_1$ is equal to $PWM_0$ as previously calculated by the microprocessor 52 plus the increment.

The initial stages of assessing current drawn by the motor are configured to be executed quickly to rapidly identify related dangerous situations, such as the motor 22 stalling and drawing a very high current. This would then result in PWM=0% being applied to the motor 22 to prevent damage.

At 92, the microprocessor 52 compares a time value to a defined temperature sampling interval (time period) stored in the memory 54. Initially, the time value is measured from "startup". Subsequently, the time value is measured from resetting the clock at 102, as discussed below. If the time value is less than the interval period, the microprocessor 52 bypasses the temperature assessment stages 94-102 and proceeds to the calculation of $PWM_0$, at 104, which is then written to the motor 22, at 106, to adjust the speed of the motor shaft 24.

The time sampling interval is defined to limit instances of temperature measurement and calculation of PWM values in order to limit computations and energy. The interval is defined to be around 5-10 seconds as temperature of compressor 10 components does not change significantly within such a period.

Where time is greater than the sample interval period, at 94, the microprocessor 52 communicates with the third sensor 60 to measure the temperature of the PCB 44 ($T_{PCB}$).

At 96, the microprocessor 52 calculates an adjustment factor ($F_1$), being a variable function based on a difference between $T_{PCB}$ and a maximum temperature threshold ($T_{PCB}$ MAX) stored in the memory 54, and a rate of $T_{PCB}$ change relative to $T_{PCB\ MAX}$. The rate of $T_{PCB}$ change is determined from comparing the sensed $T_{PCB}$ with historical sensed $T_{PCB}$ values stored in the memory 54. The microprocessor 52 then calculates another PWM value ($PWM_2$) by applying the adjustment factor $F_1$ to $PWM_0$.

The microprocessor 52 then communicates with the second sensor 58, at 98, to measure the temperature of the PCB 44 ($T_{HD}$).

At 100, the microprocessor 52 calculates an adjustment factor ($F_2$), being a variable function based on a difference between $T_{HD}$ and a maximum temperature threshold ($T_{HD}$ MAX) stored in the memory 52, and a rate of $T_{HD}$ change relative to $T_{HD}$ MAX. The rate of $T_{HD}$ change is determined from comparing the sensed $T_{HD}$ with previously received $T_{HD}$ values stored in the memory 54. The microprocessor 52 then calculates another PWM value ($PWM_3$) by applying the adjustment factor $F_2$ to $PWM_0$.

At 102, the microprocessor 52 resets the clock for the temperature sampling interval calculation at 92.

At 104, the microprocessor 52 calculates a final PWM value ($PWM_0$) by comparing the three previously calculated PWM values ($PWM_1$, $PWM_2$, $PWM_3$) and selecting the lowest PWM value. As each PWM value is calculated by assessing critical parameter values, selecting the lowest value ensures that operation of the compressor 10 at the selected PWM maintains all of the monitored critical parameters below defined safe thresholds.

At 106, the microprocessor 52 writes the selected value, $PWM_0$, to the motor 22 to adjust the rotational speed of the motor shaft 24. It will be appreciated that where each of $PWM_1$, $PWM_2$, $PWM_3$ are greater than the previously written $PWM_0$, this causes an increase in the rotational speed of the shaft 24. Conversely where any of $PWM_1$, $PWM_2$, $PWM_3$ are less than previously written $PWM_0$, this causes a decrease in the rotational speed of the shaft 24.

The process is then repeated by returning to stage 84 to measure current A. Cyclical execution of stages 84 to 106 allows operation of the motor 22 to be continuously regulated by adjusting the rotational speed of the motor shaft 24 to be as fast as possible whilst avoiding damage being caused to any component of the compressor 10.

The configuration of the microprocessor 52, and calculation of $PWM_0$, as described above is advantageous as this ensures the motor 22 is run at a maximum safe speed calculated in response to assessing the sensed critical parameters of current drawn, temperature of the PCB 44 and temperature of the cylinder head 18 relative to defined thresholds. It will be appreciated that assessing these three critical parameters is merely illustrative and that, in other embodiments, the microprocessor 52 may be configured to assess more or less critical parameters to determine $PWM_0$.

Figure 13:
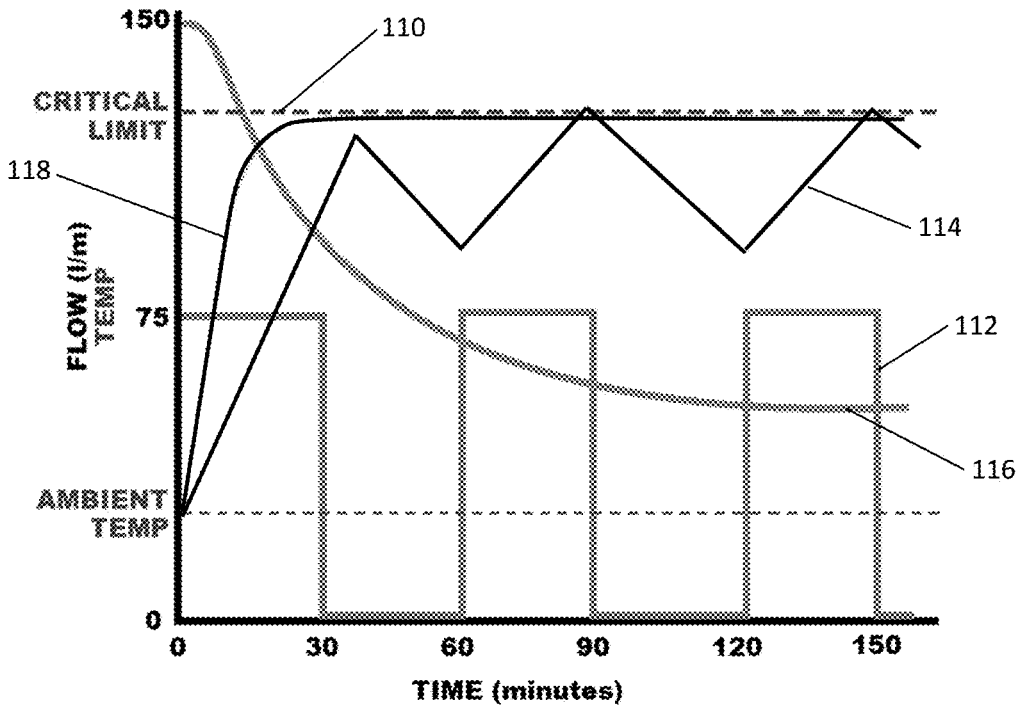
FIG. 13 is a graph illustrating output flow (litres/minute) vs. time illustrating operation of the disclosed compressors and a prior art compressor.

FIG. 13 is a graph illustrating use of a prior art compressor and the compressor 10 shown in FIGS. 1 to 3. Air flow (litres/minute) and temperature of the compressor (° C.) is defined along the y axis, and time (minutes) is defined along the x axis. A dashed line 110 illustrates a critical temperature limit, for example, a critical temperature of the motor 22.

A first plot 112 illustrates operation of the prior art compressor which has a 50% duty cycle, having a run time period of 30 minutes followed by an off time period of 30 minutes to allow cooling. This defines periods of running at 75 litres/minute, and periods running at 0 litres/minute, forming a square edged waveform.

A second plot 114 illustrates the temperature of this compressor during use where, starting from ambient temperature, the temperature progressively increases until reaching the critical temperature where a thermo-switch operates to deactivate the compressor to allow the temperature to reduce to a defined, low threshold at which the switch resupplies power.

A third plot 116 illustrates operation of the compressor 10 which has a 100% duty cycle. Due to the continuous monitoring of critical parameters by the microprocessor 52 and resulting incremental adjustment of PWM and motor shaft 24 speed, this defines an initial period of running at 150 litres/minute which progressively reduces to substantially plateau around 50 litres/minute. Comparison of the area below the third plot 116 to the area below the first plot 112 shows net flow produced by the compressor 10 within a defined period is greater than net flow produced by the prior art compressor in the same period. This therefore optimises output, for example, allowing a tank to be filled with pressurised air by the compressor 10 quicker than is filled by the prior art compressor.

A fourth plot 118 illustrates the temperature of the compressor 10 during use where, starting from ambient temperature, the temperature progressively increases until nearly reaching the critical temperature where it is held constant by progressively adjusting PWM and motor shaft 24 speed, as described above. This advantageously prevents damage to the compressor 10 due to excess heat whilst operating the motor 22 to optimise flow.

The compressor 10 is configured to operate according to a 100% duty cycle whilst optimising output. This is achieved by the microprocessor 52 continuously monitoring critical operational parameters, such as Amp draw and critical temperatures, and, in response, dynamically adjusting motor 22 speed so that the motor 22 is sustainably operated at or close to critical thresholds without damaging the compressor 10. This advantageously enhances flow rate, durability of the compressor 10 and/or user experience. Furthermore, this allows operation of the compressor 10 to vary according to local environmental conditions, such as ambient temperature and pressure It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An air compressor for use with a vehicle, the air compressor comprising:

a cylinder defining a bore;

a piston slidably arranged within the bore;

a cylinder head arranged across an end of the cylinder;

an air inlet arranged to convey air from outside of the air compressor into the cylinder;

an electric motor having a motor shaft operatively connected to the piston such that rotating the motor shaft causes the piston to reciprocate to compress air in the cylinder;

a housing defining a sealable chamber, wherein the motor is sealably contained within the chamber;

a first sensor arranged to sense a critical parameter of the air compressor; and a controller in communication with the motor, the first sensor and a memory configured to store critical parameter threshold values, the controller configured to control operation of the motor to adjust a rotational speed of the motor shaft to cause operating the compressor at a 100% duty cycle, wherein, responsive to the controller receiving a sensed value from the first sensor, the controller is configured to communicate with the memory to determine a difference between the sensed value and a relevant critical parameter threshold, and compare the sensed value to historical sensed values stored in the memory to determine a rate of change of the sensed value relative to the relevant critical parameter threshold, and responsive to the controller determining the difference and the rate of change, the controller is configured to determine an adjustment factor based on the difference and the rate of change and cause the motor to adjust the rotational speed of the motor shaft by the adjustment factor.

2. The air compressor according to claim 1, wherein responsive to the controller determining the sensed critical parameter is greater than the relevant critical parameter threshold, the controller is configured to determine a negative adjustment factor and cause the motor to reduce the rotation speed of the motor shaft by the adjustment factor.

3. The air compressor according to claim 1, wherein the first sensor is arranged to sense current drawn by the motor, and further comprising a second sensor arranged to sense a temperature of the air compressor, and wherein the controller is in communication with the second sensor to receive a sensed temperature.

4. The air compressor according to claim 3, wherein the second sensor is arranged to sense a temperature of the cylinder head, and at least one of the memory and the controller is arranged on a printed circuit board (PCB), and further comprising a third sensor arranged to sense a temperature of the PCB, and wherein the controller is in communication with the third sensor to receive a sensed temperature value.

5. The air compressor according to claim 4, wherein the PCB is sealably contained within the sealable chamber of the housing.

6. The air compressor according to claim 3, wherein, the controller is configured to communicate with each of the sensors to assess sensed values and determine a plurality of adjustment factors, each adjustment factor relating to one of the sensed critical parameters.

7. The air compressor according to claim 6, wherein responsive to the controller determining the plurality of adjustment factors, the controller is configured to cause the motor to adjust the rotational speed of the motor shaft by the greatest reduction factor.

8. The air compressor according to claim 6, wherein responsive to causing the rotational speed of the motor shaft to be adjusted, the controller is configured to repeat communicating with each of the sensors to effect operating in a cyclical routine.

9. The air compressor according to claim 1, further comprising at least one cooling duct arranged to convey air from outside of the air compressor, alongside the motor and cylinder, and through the cylinder head to emit from at least one exhaust spaced from the air inlet.

10. The air compressor according to claim 1, wherein the controller is configured as a microprocessor mounted on a printed circuit board (PCB), and the PCB is sealably contained within the sealable chamber.

11. An air compressor for use with a vehicle, the air compressor comprising:

a cylinder defining a bore;

a piston slidably arranged within the bore;

an air inlet arranged to convey air from a first location outside of the air compressor into the cylinder;

an electric motor having a motor shaft operatively connected to the piston such that rotating the motor shaft causes the piston to reciprocate to compress air in the cylinder;

a printed circuit board (PCB) carrying a microprocessor configured to control operation of the motor;

a housing defining a sealable chamber, wherein the motor and the PCB are sealably contained within the chamber, and the PCB is arranged at a first end of the chamber;

at least one cooling duct arranged to convey air from a second location outside of the air compressor, the second location proximal to the first end of the chamber and spaced apart from the first location, alongside the sealable chamber, and alongside the cylinder, to emit from at least one exhaust spaced from the air inlet; and a fan operable to impel air through the, or each, cooling duct, the fan arranged adjacent the first end of the chamber.

12. The air compressor according to claim 11, and wherein the air inlet is arranged to receive air in a first direction and the, or each, exhaust is arranged to emit air in a second direction transverse to the first direction.

13. The air compressor according to claim 11, wherein the, or each, exhaust is arranged operatively above the air inlet.

14. The air compressor according to claim 13, wherein the, or each, exhaust is arranged operatively above the cylinder.

15. The air compressor according to claim 11, wherein the housing defines at least one passage extending parallel and separate to the chamber to convey air alongside the chamber and through the housing.

16. The air compressor according to claim 15, wherein the housing defines at least one conduit arranged to convey air from the at least one passage through a right angle to the cylinder head.

17. The air compressor according to claim 16, wherein the housing includes a plurality of bodies, wherein a first body defines the sealable chamber and the at least one passage, and a second body defines the at least one conduit.

18. The air compressor according to claim 16, including a cylinder head configured to receive and surround the cylinder, the cylinder head defining at least one cooling chamber extending parallel to the cylinder to convey air alongside the cylinder, wherein the at least one cooling chamber is arranged to convey air from the at least one conduit and through the cylinder head to the at least one exhaust.

19. The air compressor according to claim 11, further comprising:

a sensor arranged to sense a critical parameter of the air compressor;

a controller in communication with the motor, the first sensor and a memory configured to store critical parameter threshold values, and configured to control operation of the motor to adjust a rotational speed of the motor shaft; and wherein, responsive to the controller receiving a sensed value from the first sensor, the controller is configured to communicate with the memory to determine a difference between the sensed critical parameter and a relevant critical parameter threshold, and responsive to the controller determining the difference, the controller determines an adjustment factor and causes the motor to adjust the rotational speed of the motor shaft by the adjustment factor.

20. An air compressor assembly including:

a pair of the air compressors according to claim 11; and a cylinder head housing shaped to receive the cylinder of each of the compressors to join the air compressors together.

21. The air compressor according to claim 20, wherein the cylinder head housing defines each exhaust.

* * * * *